US005895198A

United States Patent [19]

Lofstrom

[11] Patent Number: 5,895,198

[45] Date of Patent: Apr. 20, 1999

[54] COIL UNLOADING RIG

[76] Inventor: Roger J. Lofstrom, 151 S. Ridgedale Ave., East Hanover, N.J. 07936

[21] Appl. No.: 09/133,719

[22] Filed: Aug. 13, 1998

[51] Int. Cl.[6] ..... B66C 1/48

[52] U.S. Cl. ..... 414/684; 294/67.33; 294/67.5; 294/103.2

[58] Field of Search ..... 294/67.33, 67.5, 294/103.2; 414/684, 783

[56] References Cited

U.S. PATENT DOCUMENTS

| | | | |
|---|---|---|---|
| 2,135,890 | 11/1938 | Gedge, Jr. . | |
| 2,399,360 | 4/1946 | Lacey | 294/67.5 X |
| 2,821,318 | 1/1958 | Kendall . | |
| 2,999,716 | 9/1961 | Elberty . | |
| 3,100,123 | 8/1963 | Schmidt . | |
| 3,104,016 | 9/1963 | Harry . | |
| 3,434,612 | 3/1969 | Schmidt . | |
| 3,436,116 | 4/1969 | Anderson . | |
| 3,695,460 | 10/1972 | Borriello . | |
| 4,166,647 | 9/1979 | Schmidt | 294/78 A |
| 4,375,936 | 3/1983 | Dechantsreiter | 414/626 |
| 4,787,664 | 11/1988 | Borriello | 294/103.2 |

FOREIGN PATENT DOCUMENTS

| | | | |
|---|---|---|---|
| 42 03 151 | 8/1993 | Germany | 294/67.5 |

*Primary Examiner*—Janice L. Krizek
*Attorney, Agent, or Firm*—Kane, Dalsimer, Sullivan, Kurucz, Levy, Eisele and Richard, LLP

[57] ABSTRACT

A coil unloading rig is adapted to handle, tilt and position a coil of sheet metal. An arcuate rail has opposed upper and lower open ends and an intermediate arcuate section. A trolley rotatably suspends the rail from a ceiling crane. A ring is disposed in a plane normal to the plane of the rail. A top brace is fixed to the upper rail end and the ring and a lower brace is fixed to the lower rail end and the ring. A pair of divergent posts are on each side of the lower brace, each post having post brackets for supporting and clamping the coil in a vertical position. A vertically movable brace bracket is movably mounted on the top brace for supporting and clamping the coil supported by the post brackets whereby the coil unloading rig is adapted to support and clamp a coil in a vertical position and tilt the coil by rotating the rail by the trolley to a horizontal position.

9 Claims, 4 Drawing Sheets

COIL UNLOADING RIG

FIELD OF THE INVENTION

This invention relates to a coil unloading rig to be received by a crane for transporting a coil of slit sheet steel from a vertical position to a horizontal position.

BACKGROUND OF THE INVENTION

There exists a need for a practical and economical coil handling mechanism for positioning, handling and/or transferring metal coils from one location to another, particularly in mills as well as warehouses. The problem of handling metal coils is accentuated by the fact that the coils may be stored or disposed with their axis vertically or horizontally, or may be received on a pallet or conveyor with the axis either vertical or horizontal. Therefore, the coil handling mechanism is required to be selectively tiltable and preferably constructed to be conveniently coupled with and transported by a ceiling crane.

Metallic strip material is normally coiled to enable this material to be handled, and transferred to another location either for further processing or for shipment to a customer. By reason of the orientation of processing lines, as for example, that of a coil slitting station, the coiled strip is disposed on a horizontal axis and supported on a horizontally extending mandrel. These coils, even after slitting, are extremely heavy.

Although the coils are wound and unwound on a horizontal axis or after slitting are disposed on a horizontal axis, it is preferred to store or prepare the coils for shipment to customers with their axis vertical. In this manner, the coils are stable and may be stacked upon one another on a shipping skid or pallet for shipping.

While it has been proposed in the industry to use tilters to tilt newly formed coils from a horizontal to a vertical axis after coiling and then from a vertical to horizontal axis for further processing, these mechanisms are heavy and expensive and many are fixed and not capable of being readily moved from one location to another in a mill or customer plant.

SUMMARY OF THE INVENTION

A principal object of the present invention is to provide a tiltable coil unloading rig that is not heavy nor expensive but light enough in weight to be easily and safely moved and manipulated while being practical and inexpensive enough to be affordable by relatively small plants or shops that further process slit coils of varying reduced widths.

Another object is to provide a coil unloading rig of the foregoing type that is capable of moving a coil from a vertical orientation at which the coil axis is horizontal to a horizontal position at which the coil axis is vertical, all with little effort by only one individual which adds to the cost effectiveness of the rig.

A further object is to provide a coil unloading rig of the foregoing type that is readily coupled with conventional traveling cranes supported by overhead rails.

A specific object is to provide a simple yet rugged rig of the foregoing type that may be used in the removal of slit pancake coils from a rewind mandrel or turnstile transfer arm.

Other objects and advantages will become apparent from the following detailed description which is to be taken in conjunction with the accompanying drawing.

DETAILED DESCRIPTION

Figure 1:
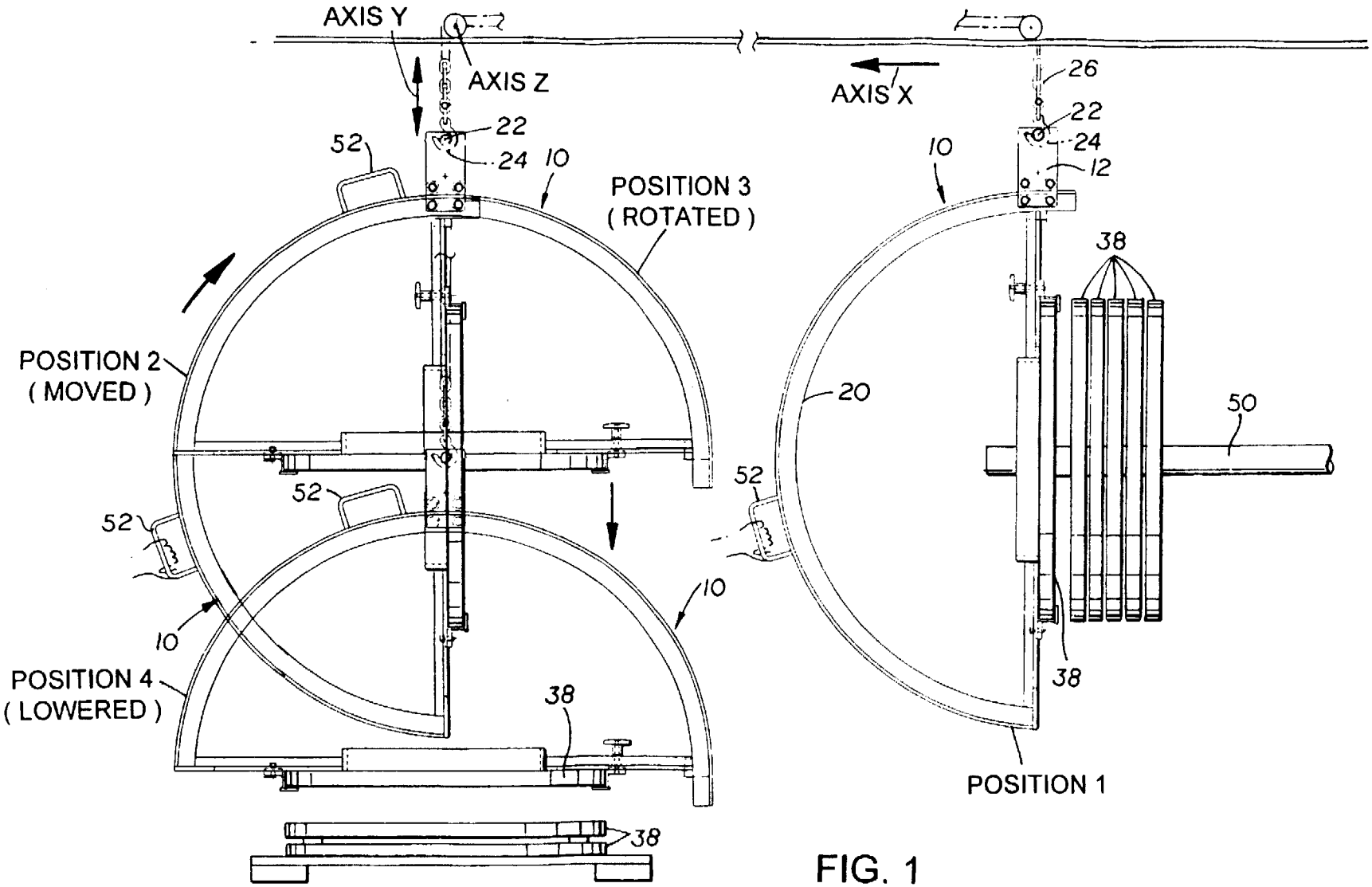
FIG. 1 is a side elevational view showing the sequence of positions of the coil unloading rig in transferring a coil from a horizontal mandrel to a shipping skid.

In the drawings, an arcuate rail 10, possessing a T-beam cross section, is movably suspended by trolley 12 having spaced but coupled plates 14*a*, 14*b* having internally mounted pairs of wheels 16*a*, 16*b* and 18*a*, 18*b*. Arcuate flange 20 of rail 10 is interposed between wheels 16*a*, 16*b* and 18*a*, 18*b* for relative rotational or tilting movement. An upper pin 22 of the trolley 12 is adapted to be coupled with a crane hook 24 suspended by a chain 26 of a ceiling crane (not shown).

A central ring 28 is anchored to the rail 10 by a bottom brace 30 and a top brace 32 as, for example, by welds. These braces may possess a U-shaped or H-shaped cross section. Extending downwardly and outwardly from the ring 28 and suitably fixed thereto, such as by welding, are posts 34 and 36. Each post includes an elongated slot 34*a* and 36*a* and a series of circular recesses 34*b*, 36*b*, respectively. The slots receive the shank of a threaded bolt 34*c*, 36*c* which are threadedly received by tapped openings in coil clamping brackets 34*d*, 36*d*, respectively. This arrangement permits the brackets 34*d*, 36*d* to be raised or lowered to accommodate coils of different diameter. The threaded bolts 34*c*, 36*c* have a head 34*e*, 36*e* that conveniently mate with the circular recesses 34*b*, 36*b* in securing the selected position of the bolt 34*c*, 36*c*, and, consequently, the brackets 34*d*, 36*d*. Each bracket 34*c*, 34*d* has an upstanding flange 34*f*, 36*f* for cooperating in clamping or otherwise securing the coil 38 as shown in phantom in the drawings.

Figure 2:
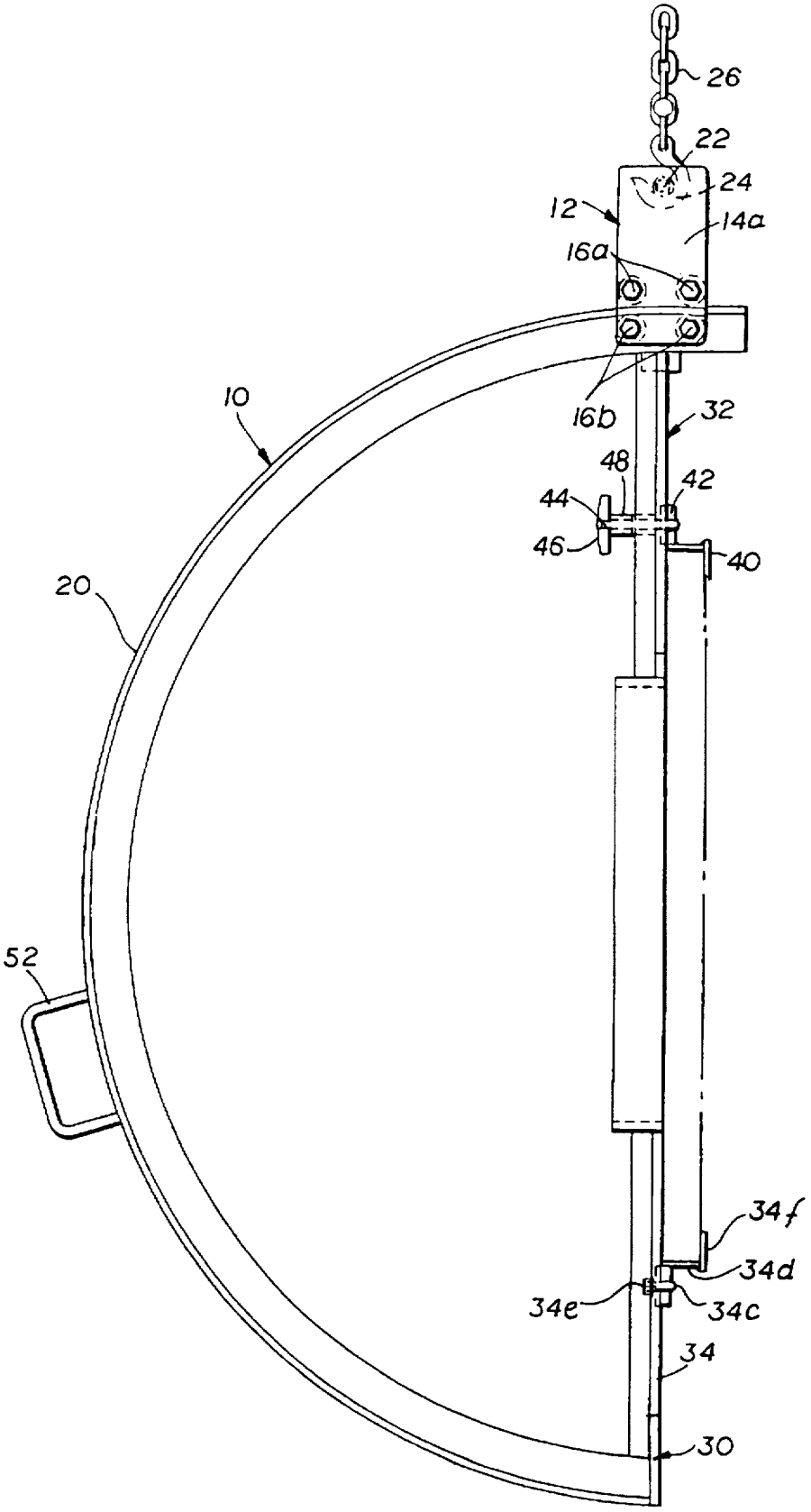
FIG. 2 is an enlarged side elevational view showing the rig in a vertical position.
Figure 3:
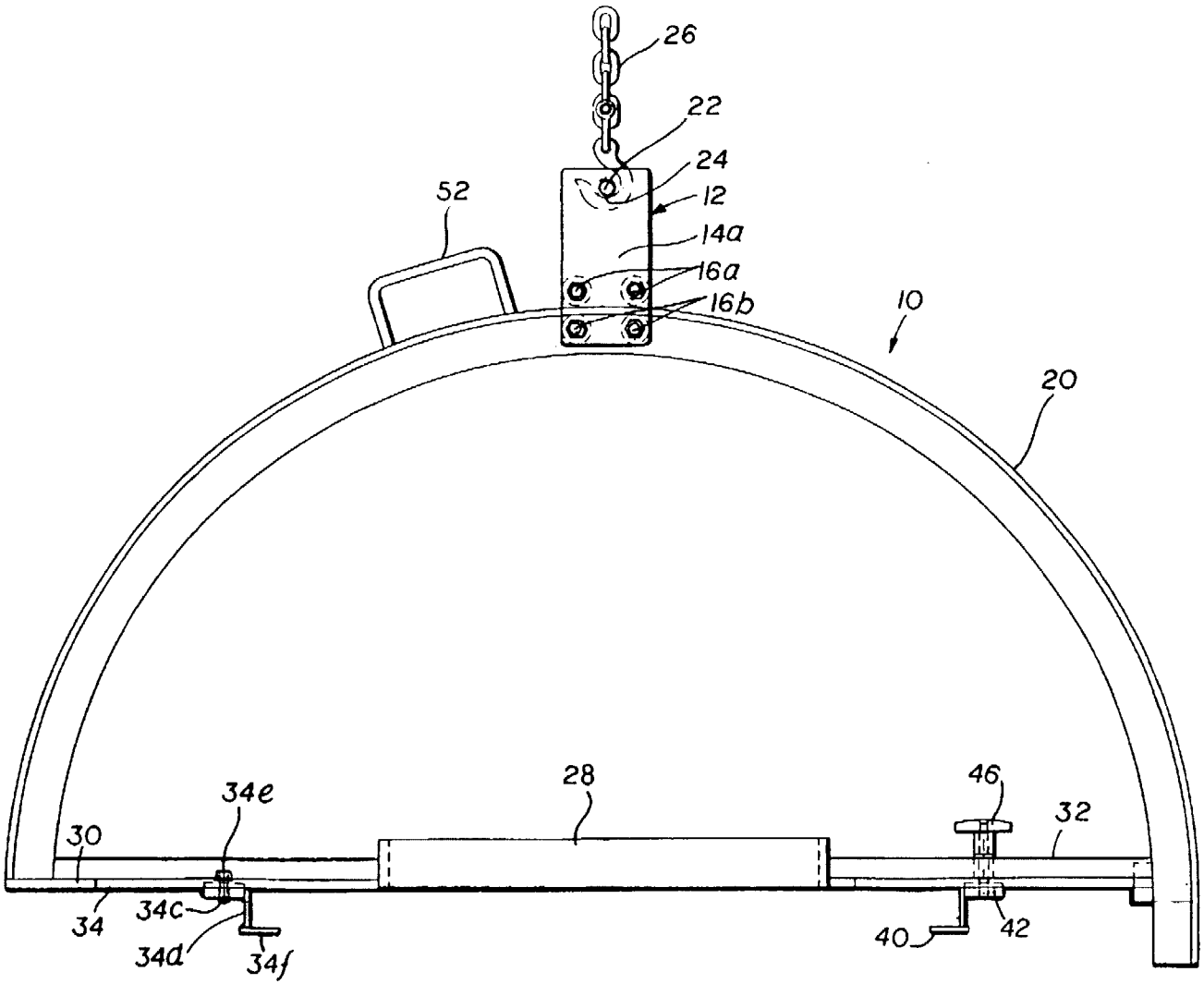
FIG. 3 is an enlarged side elevational view showing the rig in a horizontal position.
Figure 4:
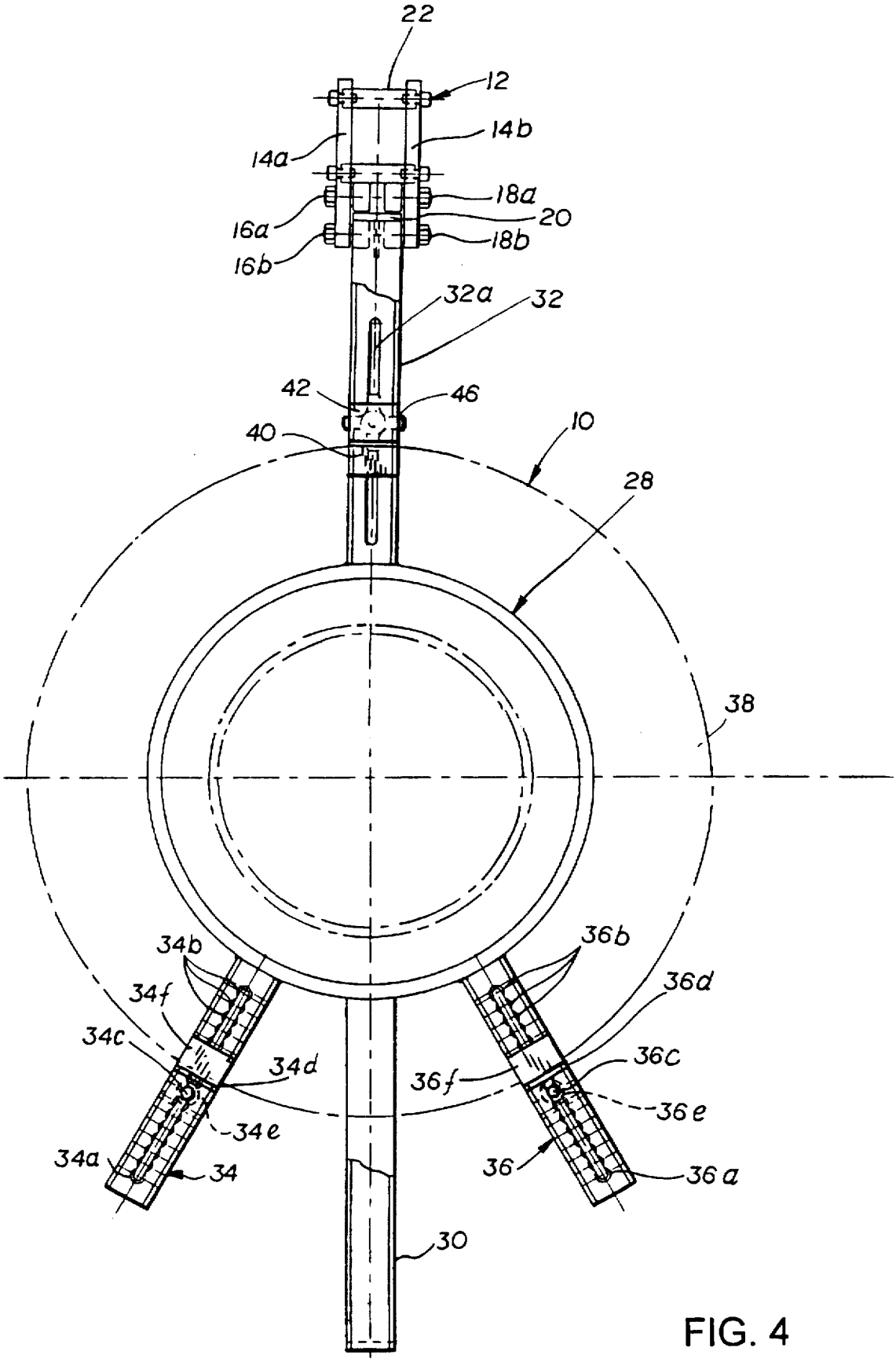
FIG. 4 is a front elevational view showing the rig in a vertical position.

In order to complete the clamping of the coil 38, a vertically movable coil clamping bracket 40 is adapted to be secured to brace 32. In this regard, nut 42 fixed to the bracket 40 threadedly receives bolt 44 slidable in slot 32*a* of brace 32. A handle 46 facilitates the turning of bolt 44 which permits sleeve 48 to engage with surfaces of the brace 32 on each side of the slot 32*a* in anchoring bracket 40 in its coil clamping position as shown in FIG. 2.

In operation, and with specific reference to removal of a suitably banded slit pancake coil 38 from a rewind mandrel 50, the illustrated coil unloading rig is moved by a ceiling crane to a location near the mandrel 50. Handle 52 is grasped for facilitating the orientation of the rig 28 and braces 30, 32 in a vertical direction. The lower brackets 34*d*, 36*d* engage with and clamp the coil 38 by raising these flanges under the coil by the ceiling crane. Prior to this, the upper bracket 40 is raised by loosening the bolt 44 by turning the handle 46. When the lower brackets 34*d*, 36*d* have engaged with coil 38, the upper bracket 40 is lowered into coil clamping position at which time the bolt 44 is tightened by turning the handle 46 so sleeve 48 engages tightly with surfaces of brace 32.

The clamped coil 38 is then lifted off the mandrel 50 and then transferred to the desired location by the ceiling crane. If the coil 38 is to be placed on a shipping skid or pallet, the handle 52 is grasped and the rail is turned or tilted clockwise on the wheels 16*a*, 16*b* and 18*a*, 18*b* until the coil is horizontal facing downwardly. The ceiling crane then lowers the clamped coil 38 down onto the skid or pallet. The handle 46 is turned to unloosen bolt 44 to permit the clamping bracket 40 to be withdrawn from the coil. The entire rig is then moved to free brackets 34*d*, 36*d* from the coil 38. The foregoing operation may then be repeated to unload further coils from the mandrel 50 and stack them on the skid.

Thus, the several aforenoted objects and advantages are most effectively attained. Although a single somewhat preferred embodiment of the invention has been disclosed and described in detail herein, it should be understood that this invention is in no sense limited thereby and its scope is to be determined by that of the appended claims.

I claim:

1. A coil unloading rig for handling, tilting and positioning a coil of sheet metal having a first axis, comprising in combination:

an arcuate rail disposed in a first plane and having opposed upper and lower open ends and an intermediate arcuate section;

a trolley having means for rotatably suspending the rail from a ceiling crane;

a ring having a second axis disposed in a second plane normal to the first plane of the rail;

a top brace fixed to the upper rail end and the ring and being disposed in the second plane;

a lower braced fixed to the lower rail end and the ring and being disposed in the second plane;

a pair of divergent posts on each side of the lower brace, each post being disposed in the second plane, each post having post bracket means for supporting and clamping the coil in a vertical position with the coil axis being substantially parallel to the ring axis;

a vertically movable brace bracket means being movably mounted on the top brace for supporting and clamping the coil supported by the post bracket means whereby the coil unloading rig is adapted to support and clamp a coil in a vertical position having a horizontal axis and tilt the coil by rotating the rail by the rotatably suspending means to a horizontal position having a vertical axis.

2. The invention in accordance with claim 1 wherein the rail is semi-circular in configuration and includes a handle for manually handling and positioning a coil.

3. The invention in accordance with claim 1 wherein the means for rotatably suspending the rail includes rotatable wheels for engaging with surfaces of the rail for facilitating the rotational tilting of the rail on the wheels and relative to the trolley.

4. The invention in accordance with claim 3 wherein the rail is a T-beam in cross section having an underside and top side, and a pair of the wheels engaging the underside of the T-beam and a pair of the wheels engaging the top side of the T-beam.

5. The invention in accordance with claim 1 wherein the trolley includes means for engaging with a hook of a ceiling crane.

6. The invention in accordance with claim 1 wherein the top brace includes an elongated slot and the vertically movable brace bracket means includes a threaded bolt movable in the slot, a nut engageable with surfaces of the top brace and threadedly receiving the bolt, and a bracket fixed to the nut, a handle on the bolt for facilitating the turning of the bolt and sleeve means for engaging with surfaces of the top brace whereby the bolt is adapted to be unloosened to permit the brace bracket means to be raised and following holding and clamping of the coil by the post bracket means, the brace bracket means is adapted to be lowered to hold and clamp the coil by rotating the handle to tighten the bolt and cause engagement of the nut and sleeve means with surfaces of the top brace, and when the coil has been tilted to a horizontal position, the brace bracket means is adapted to be moved by loosening the bolt to free the coil.

7. The invention in accordance with claim 1 wherein each post includes an elongated slot and a series of circular recesses aligned with the slot, each post bracket means includes a bolt having a shank moveable in the slot and a head for mating in one of the circular recesses, a bracket having an upstanding flange for holding and clamping the coil and means for threadedly receiving the bolt whereby each post bracket means is adapted to be adjusted on the posts by loosening the bolt and moving it in the slot to a selected one of the recesses at which point the bolt is tightened and the head made to engage the post in one of the recesses and with the post bracket means tightened the coil is adapted to be held and clamped by the post bracket means.

8. The invention in accordance with claim 7 wherein the top brace includes an elongated slot and the vertically movable brace bracket means includes a threaded bolt movable in the slot, a nut engageable with surfaces of the top brace and threadedly receiving the bolt, and a bracket fixed to the nut, a handle on the bolt for facilitating the turning of the bolt and sleeve means for engaging with surfaces of the top brace whereby the bolt is adapted to be unloosened to permit the brace bracket means to be raised and following holding and clamping of the coil by the post bracket means, the brace bracket means is adapted to be lowered to hold and clamp the coil by rotating the handle to tighten the bolt and cause engagement of the nut and sleeve means with surfaces of the top brace, and when the coil has been tilted to a horizontal position, the brace bracket means is adapted to be moved by loosening the bolt to free the coil.

9. The invention in accordance with claim 8 wherein the rail is semi-circular in configuration and includes a handle for manually handling and positioning a coil, the means for rotatably suspending the rail includes rotatable wheels for engaging with surfaces of the rail for facilitating the rotational tilting of the rail on the wheels and relative to the trolley, the rail is a T-beam in cross section and a pair of the wheels engage the underside of the T-beam and a pair of the wheels engage the top side of the T-beam, and the trolley includes means for engaging with a hook of a ceiling crane.

* * * * *